US005759985A

United States Patent [19]

Henry

[11] Patent Number: 5,759,985

[45] Date of Patent: Jun. 2, 1998

[54] COMPOSITIONS FOR THE STABILIZATION OF BROMOCHLOROMETHANE

[75] Inventor: Richard G. Henry, Cuyahoga County, Ohio

[73] Assignee: Advanced Chemical Design, Inc., Euclid, Ohio

[21] Appl. No.: 932,724

[22] Filed: Sep. 18, 1997

Related U.S. Application Data

[63] Continuation of Ser. No. 505,750, Jul. 21, 1995, abandoned.

[51] Int. Cl.[6] ..... C11D 7/30; C11D 7/26; C11D 7/52; C11D 7/60

[52] U.S. Cl. ..... 510/412; 510/365; 510/273; 510/175; 510/255; 510/256; 510/258; 510/263; 510/499; 510/506; 134/42; 134/2; 134/40; 252/364

[58] Field of Search ..... 134/40, 42, 2, 134/11; 570/110, 115, 116; 510/412, 365, 175, 255, 256, 258, 263, 506, 499

[56] References Cited

U.S. PATENT DOCUMENTS

| | | | |
|---|---|---|---|
| 3,049,571 | 8/1962 | Brown | 260/652.5 |
| 3,113,156 | 12/1963 | Sims | 260/652.5 |
| 3,657,120 | 4/1972 | Porst | 252/8 |
| 3,730,904 | 5/1973 | Clementson et al. | 134/40 X |
| 3,773,677 | 11/1973 | Boyles | 252/172 |
| 3,879,297 | 4/1975 | Languille et al. | 252/8 |
| 3,881,949 | 5/1975 | Brock | 134/40 X |
| 3,924,455 | 12/1975 | Bergishagen et al. | 73/88 |
| 3,950,185 | 4/1976 | Toyama et al. | 134/38 |
| 4,018,837 | 4/1977 | Archer et al. | 260/652.5 |
| 4,056,403 | 11/1977 | Cramer et al. | 134/40 X |
| 4,115,461 | 9/1978 | Spencer et al. | 260/652.5 |
| 4,193,838 | 3/1980 | Kelly et al. | 162/5 |
| 4,806,276 | 2/1989 | Maier | 252/171 X |
| 5,207,953 | 5/1993 | Thorssen et al. | 252/601 |
| 5,286,422 | 2/1994 | Kato et al. | 264/13 |
| 5,302,313 | 4/1994 | Asano et al. | 252/170 |
| 5,403,507 | 4/1995 | Henry | 252/170 |
| 5,616,549 | 4/1997 | Clark | 510/412 |
| 5,665,170 | 9/1997 | Lee et al. | 134/19 |
| 5,690,862 | 11/1997 | Moore et al. | 252/364 |

FOREIGN PATENT DOCUMENTS

| | | |
|---|---|---|
| 59-136399 | 8/1984 | Japan . |
| 3097793 | 4/1991 | Japan . |
| 7292393 | 11/1995 | Japan . |

*Primary Examiner*—Douglas J. McGinty
*Attorney, Agent, or Firm*—Fay, Sharpe, Beall, Fagan, Minnich & McKee

[57] ABSTRACT

A combination of stabilizers and bromochloromethane are used as a cleaning composition in which the bromochloromethane is stabilized against decomposition and the release of bromine into the atmosphere.

7 Claims, No Drawings

COMPOSITIONS FOR THE STABILIZATION OF BROMOCHLOROMETHANE

This is a continuation of application Ser. No. 08/505,750, filed Jul. 21, 1995, abandoned.

FIELD OF THE INVENTION

This invention relates to techniques for stabilizing bromochloromethane against vapor or liquid phase decomposition caused by thermal degradation, contact with various metals or contact with water.

DESCRIPTION OF PRIOR ART

Previously in the art, 1,1,1-trichloroethane (hereinafter "TCE") has been used for cold cleaning and hot vapor cleaning of various materials. Because of TCE's relatively high ozone depletion potential of 0.12, it has become a target of the Environmental Protection Agency. A need for a solvent with a lower ozone depletion potential has developed. Because Bromochloromethane has an ozone depletion potential of only about 0.02 which is approximately a 84% improvement over TCE, it has been proposed as a substitute for TCE.

Many stabilizers for TCE have been developed but not all work well with bromochloromethane. The applicant has disclosed a stabilizer package which is useful in combination with bromochloromethane for vapor degreasing in his currently pending U.S. patent application Ser. No. 08/293,047, now abandoned. The stabilizer package comprises nitromethane, 1,2-butylene oxide and 1,3-dioxolane or 1,4-dioxane. This package only works when there is no moisture on the work being introduced into the solvent. When water based cutting fluids are being cleaned off the metal, for example, it is impossible to use the stabilizer package because the presence of the water causes solvent degradation. Only a small amount of water needs to be introduced into the solvent in order to cause immediate solvent degradation and the production of corrosive amounts of hydrochloric acid or hydrogen bromide, as the case may be. This solvent degradation is entirely unacceptable for many commercial applications.

A need exists, therefore, for a stabilization system for bromochloromethane against both metal initiated decomposition and water initiated decomposition.

SUMMARY OF THE INVENTION

This invention describes an improved cleaning composition comprising bromochloromethane and at least one stabilizing agent. The stabilizing agent is present in the cleaning composition in an amount effective to inhibit the decomposition of the bromochloromethane. The stabilizing agent is typically present in an amount of about $1\times10^{-5}$ wt. % to about 10 wt. % of the total cleaning composition. Preferably, the stabilizing agent is present in the amount of about 0.1 wt. % to about 1.5 wt. % of the total cleaning compound.

DETAILED DESCRIPTION

Bromochloromethane is a superior solvent for grease, oils, tars, and waxes and it is known to be non-flammable and less poisonous than other brominated hydrocarbons. Because of these desirable properties, bromochloromethane can be used as a grease-removing solvent for a variety of light and heavy metals. Its full industrial acceptance has remained limited, since it easily decomposes when in contact with certain metals and in the presence of water, which tends to generate corrosive amounts of hydrogen bromide. This decomposition can occur even when the solvent is used in a cold liquid phase, although the decomposition reaction is more likely to occur at high temperatures and especially in the hot vapor phase. This tendency to decompose in the hot vapor phase has become an increasingly severe detriment, in view of the current industrial need for an environmentally safe solvent.

It has been noted that when bromochloromethane is used in combination with at least one stabilizing agent, the degradation of the bromochloromethane is inhibited. Once the bromochloromethane has been properly stabilized, it can be more effectively used as a solvent to remove greases and oil and as an electrical contact cleaner for the removal of hydrocarbon soluble fluxes. The stabilized bromochloromethane can be used to clean metals, plastics, elastomers and circuit boards.

Only a quantity of inhibitor sufficient to retard or to stop the reaction of metals and water with bromochloromethane need be used. Table 1 lists the most characteristic and effective stabilizing agents for stabilization of bromochloromethane. Column 1 provides a list of stabilizing agents which can be used in combination with bromochloromethane to provide an improved cleaning composition. The stabilizing agent can be used alone or in combination with the additional component or components listed directly across from it in the third column to form a multi-component stabilizing agent. The cleaning solution of this invention includes about 0.00001 wt. % to 10 wt. % of at least one stabilizing agent, with the remainder of the solution being bromochloromethane. Optimum concentrations of the stabilizing agents range from about 0.1 wt % to about 1.5 wt. %. When a stabilizing agent is used in combination with one of the additional components, the total concentration of the stabilizing agent and additional component ranges from about 0.00001 wt. % to about 10 wt. % and preferably from about 0.1 wt. % to about 1.5 wt. %.

Stabilizing Agents
Used for the Stabilization of Bromochloromethane

| Stabilizing Agent | wt. % | Additional Components | wt. % |
|---|---|---|---|
| pyridine | 0.001–0.3 | butylpyrocatechol | 0.001–0.3 |
| triethylamine | 0.01–0.3 | butylene oxide | 0.001–0.3 |
| morpholine | 0.1–1.0 | phenol | 0.001–1.0 |
| n-alkylmorpholines in which the alkyl group has 1–7 carbon atoms | 0.001–0.1 | alkyl phenols in which the alkyl group has 1–7 carbon atoms | 0.001–1.0 |
| n-alkylpyrroles in which the alkyl group has 1–7 carbon atoms | 0.001–1.0 | tetrahydrofuran, or mono- or bicyclic epoxy compounds | 0.01–1.0 |
| diisoalkylamines having 3–4 carbon atoms | 0.001–1.0 | alkylphenol, in which the alkyl group has 1–7 carbon atoms, or aliphatic alcohols having 1–10 carbon atoms, straight chain or branched chain ketones having 1–10 carbon atoms | 0.001–1.0 |
| dicyclohexylamine | 0.001–0.5 | mono- or bicyclic epoxy comps. or phenol | 0.01.1.0 |
| aliphatic alcohols having 1–10 | 0.1–4.0 | nitro cpds. or phenol and its | 0.05–1.0 |

-continued

Stabilizing Agents
Used for the Stabilization of Bromochloromethane

| Stabilizing Agent | wt. % | Additional Components | wt. % |
|---|---|---|---|
| carbon atoms | | derivatives including napthols | |
| propargyl alcohol | 0.001–1.0 | epichlorohydrin, nitromethane, N-methyl pyrrole or 1,1-dialkylhydrazine in which the alkyl group has 1–10 carbon atoms | 0.001–0.5 |
| glycerol | 0.001–1.0 | phenol and its derivatives, mono- or bicyclic epoxy cpds., diisopropyl-amine | 0.001–1.0 |
| 3-methyl-pentyn -3-ol | 0.3–1.0 | epichlorohydrin, dihydrooxybutane, or phenol | 0.05–1.0 |
| epichlorohydrin | 0.002–0.5 | aliphatic amines having 1–5 carbon atoms, propargyl alcohol, or nitroalkanes having 1–7 carbon atoms, or phenol | 0.001–0.5 |
| epibromohydrin | 0.002–0.5 | n-methylmorpholine or allyl glycidyl ether in which the allyl group has 1–10 carbon atoms | 0.001–0.5 |
| butylene oxide | 0.25–0.5 | phenols and its derivatives, lactams, oximes, hydrazones, disulfides, acetals, amines | 0.001–1.0 |
| furan | 1.0–10.0 | phenyl glycidyl ether, aliphatic nitro cpds. having 1–7 carbon atoms or acetals | 0.005–0.5 |
| phenol and derivatives | 0.02–1.0 | amines having 1–7 carbon atoms, aliphatic alcohols having 1–10 carbon atoms, or epichlorohydrin | 0.0001–10.0 |
| ethers having 1–5 carbon atoms | 0.05–5.0 | diethylethanolamine | 0.1–5.0 |
| nitroalkanes having 1–7 carbon atoms | 0.01–5.0 | pyrrole and its derivatives or phenol | 0.1–5.0 |
| cyclohepta-1,3, 5-triene | 0.01–5.0 | unsaturated tertiary amines having 1–10 carbon atoms | 0.03–0.6 |
| 1,4-dioxane | 1.0–10.0 | styrene oxide or phenyl glycidyl ether | 0.001–5.0 |

The following examples illustrate the stabilizing effects obtainable by employing some of the combinations of compounds set forth in Table 1. In each example, the indicated stabilizer system was added, in the amounts indicated, to 500 grams of bromochloromethane containing 1 ml. of water. A strip measuring 1.25 inches×0.5 inch of each of aluminum foil, galvanized iron, and mild steel was suspended in the vapor phase of the refluxing solvent, and similar strips were suspended in the liquid phase of the solvent. After refluxing the solvent for 24 hours, the metal strips were visually examined for corrosion. The concentration given in the examples are percent by weight.

EXAMPLE 1

Stabilizer system:

0.1% p-tert-amyl phenol 0.3% 3-methyl-1-pentyn-3-ol

Observation: No signs of solvent degradation were noted.

EXAMPLE 2

Stabilizer system:

0.1% resorcinol 0.3% 3-methyl-1-pentyn-3-ol

Observation: Corrosion was noted on all strips of metal in both the vapor phase and the liquid phase. The bromochloromethane became a light yellow color.

EXAMPLE 3

Stabilizer system:

0.1% 5,6,7,8-tetramethyl-5,6,7,8-tetrahydro-2-naphthol 0.3% 3-methyl-1-pentyn-3-ol.

Observations: The solvent mixture had retained its original color and no signs of metal corrosion were noted.

Examples 1–3 utilized a combination of a tertiary acetylenic monohydric alcohol and a phenolic compound.

EXAMPLE 4

Stabilizer system 0.09% furfuryl alcohol

Observations: The solvent mixture had retained its original color and no signs of metal corrosion were noted.

EXAMPLE 5

Stabilizer system:

0.012% furfuryl mercaptan

Observations: The solvent mixture had retained its original color and no signs of metal corrosion were noted.

Examples 4–5 utilized a small amount of either a cyclic carbinol or a corresponding mercaptan. Concentrations of 0.05–0.5 weight percent provide significant inhibition.

EXAMPLE 6

Stabilizer system:

2.0% 1,4-dioxane 0.03% styrene oxide

Observations: The solvent mixture had retained its original color and no signs of metal corrosion were noted.

EXAMPLE 7

Stabilizer system:

2.0% 1,4-dioxane 0.03% phenyl glycidyl ether

Observations: The solvent mixture had retained its original color and no signs of metal corrosion were noted.

EXAMPLE 8

Stabilizer system:

3.0% 1,3-dioxolane 0.5% nitromethane 0.5% phenyl glycidyl ether

Observations: The solvent mixture had retained its original color and no signs of metal corrosion were noted.

EXAMPLE 9

Stabilizer system:

0.5% nitromethane

Observations: The solvent mixture had turned yellow and there were signs of heavy corrosion on all of the metal strips in both the vapor phase the liquid phase. This indicates that nitromethane when used alone is not an effective stabilizer when the mixture is heated.

Examples 7–8 utilize a primary stabilizer such as styrene oxide, phenyl glycidyl either and mixture thereof and a second stabilizer from the group of a primary, secondary or tertiary alkanol, a 1–3 carbon atom aliphatic nitro compound, 1,4-dioxane or 1,3-dioxolane.

Having described the invention in detail and by reference to preferred embodiments thereof, it will be apparent that modifications and variations are possible without departing from the scope of the invention defined in the appended claims.

What is claimed is:

1. A cleaning composition consisting essentially of bromochloromethane and about 0.00001 wt % to about 10 wt % of at least one multi-component stabilizing agent selected from the group consisting of 1,4-dioxane and styrene oxide; 1,4-dioxane and phenyl glycidyl ether; 1,3-dioxolane, nitromethane, and phenyl glycidyl ether; p-tertamylphenol and 3-methyl-1-pentyn-3-ol; and 5,6,7,8-tetramethyl-5,6,7,8-tetrahydro-2-naphthol and 3-methyl-1-pentyn-3-ol.

2. The cleaning composition of claim 1 wherein the multicomponent stabilizing agent consisting essentially of 1,4-dioxane and styrene oxide.

3. The cleaning composition of claim 1 wherein the multicomponent stabilizing agent consisting essentially of 1,4-dioxane and phenyl glycidyl ether.

4. The cleaning composition of claim 1 wherein the multicomponent stabilizing agent consisting essentially of 1,3-dioxolane, nitromethane and phenyl glycidyl ether.

5. The cleaning composition of claim 1 wherein the multicomponent stabilizing agent consisting essentially of p-tertamylphenol and 3-methyl-1-pentyn-3-ol.

6. The cleaning composition of claim 1 wherein the multicomponent stabilizing agent consisting essentially of 5,6,7,8-tetramethyl 5,6,7,8-tetrahydro-2-naphthol and 3-methyl-1-pentyn-3-ol.

7. The cleaning composition of claim 1 wherein the multi-component stabilizing agent is present in amount of about 0.1 wt % to about 1.5 wt %.

* * * * *